US005802618A

United States Patent [19]

Mustata

[11] Patent Number: 5,802,618

[45] Date of Patent: Sep. 8, 1998

[54] NECK AND CHEST SCARF

[76] Inventor: Eduardo J. Mustata, 1140 Abbott Rd., E. Lansing, Mich. 48823

[21] Appl. No.: 770,184

[22] Filed: Dec. 19, 1996

[51] Int. Cl.[6] ..... A41D 23/00

[52] U.S. Cl. ..... 2/207; 2/468; 2/916

[58] Field of Search ..... 2/49.1, 207, 468, 2/46, 48, 49.3, 50, 51, 916

[56] References Cited

U.S. PATENT DOCUMENTS

| | | | |
|---|---|---|---|
| D. 339,676 | 9/1993 | Geving | D2/500 |
| D. 368,571 | 4/1996 | Worku | D2/500 |
| 3,439,360 | 4/1969 | Grubman | 2/155 |
| 3,748,661 | 7/1973 | Smith | 2/207 |
| 4,404,688 | 9/1983 | Knight | 2/207 |
| 4,654,897 | 4/1987 | Rosgen | 2/207 |
| 4,686,710 | 8/1987 | Marston et al. | 2/468 |
| 4,870,707 | 10/1989 | Hayes | 2/207 |
| 5,058,211 | 10/1991 | Hanks | 2/207 |
| 5,062,157 | 11/1991 | Muta | 2/207 |
| 5,253,369 | 10/1993 | Pattetson, Jr. | 2/207 |
| 5,414,869 | 5/1995 | Thomson | 2/207 |

*Primary Examiner*—Diana Biefeld
*Attorney, Agent, or Firm*—Mary M. Moyne; Ian C. McLeod

[57] ABSTRACT

An instantaneous reversible scarf consisting of a neckpiece, built out of two similar patterns (1 and 2), and a bib or chestpiece, constructed of 2 similar patterns (13,14), and a hook 15. Patterns 1 and 13, and patterns 2 and 14 are fastenened separately prior to constructing the scarf. The single pieces obtained from fastening the conjugate patterns are then fastened together so as to construct a single double sided piece having a chestpiece and a neckpiece. A fastener 16 and its mate 17 are placed on opposite ends and opposite faces of neckpiece and a hook 15 is attached to the resulting shape for ease of storing.

8 Claims, 3 Drawing Sheets

NECK AND CHEST SCARF

BACKGROUND-FIELD OF APPLICATION

The instant reversible scarf, or niftyscarf, is an innovative scarf design that provides the user with a user friendly, easy to store, tailless, reversible article of apparrel for the neck, chest and face.

BACKGROUND-PREVIOUS ART

Generally, scarfs are thought of as long pieces of cloth having a length greater than their width dimension, that are used to keep a users neck protected from cold and wind. They are sold worldwide and are used for the purpose stated. Other scarfs are simply ornamental and will not be discussed here.

Several disadvantages exist with the traditional scarf design. First, the scarf dimensions are generally inadequate to meet a particular users needs. For example, a scarf may be too wide or too narrow for the user thereby leading to failure in protecting adequately from the ravages of cold or wind. The scarf may also be too long, leading to unwanted excess bulkiness when the scarf is tied, or too short such that the user does not have enough length for covering and tying at the same time.

A second disadvantage is that of tying the scarf. Traditional designs are hard to tie and, at best, lead to unwanted and unsteady knots around the users neck. Additionally, the lack of fixity caused by not tying the device correctly causes the scarf to undo itself while on the users neck simply as a result of normal head and neck motion. This renders the traditional designs inefficient in protecting the user against cold and wind. As most people who use traditional designs probably know, tying the scarf is extremely user unfriendly. Obtaining and keeping the right amount of tension on the scarf to hold it in place is an even more difficult task.

Thirdly, traditional scarfs are generally not reversible and depict only one color or design. Thus, the user is confined to one artistic design or material per scarf.

Fourthly, traditional scarfs are generally not tailless, meaning that much of the scarf is left over after the user has placed it on the neck. This left over material does not contribute to protecting the user from the elements, but rather causes undesirable bulkiness around the neck and chest areas.

Fifth, traditional scarf designs are only protective of a portion of the neck of the user. This means that, as the user performs normal head and neck motion, there will be a spot at the base of the users neck that will inevitable remain unprotected because traditional scarfs will undo and lift readily from that area. This lifting effect results from the natural widening of the neck to form the chest, which causes the traditional scarf to loose grip and leak cold air into the body through the spot. This is true even when a coat is worn over the scarf, such that cold air leaked through (or into) the coat will leak into the chest area of the user and penetrate into the body through the weak spot. Thus, although the users neck will be covered by the scarf, the weak spot at the base of his neck will leak cold air into the chest. In general, all shapes not designed to protect the users chest suffer this limitation, including tailless designs.

Sixth, traditional scarf designs are not easily stored by hanging because the user has to guess the center of gravity of the piece before it can balance on a coat hanger or hook. For the user exhausted from a hard days work, the last thing needed is a wrestling match with his scarf.

BACKGROUND-CROSS REFERENCE

Several attempts have been made to modify the traditional scarf design and make it user friendly. For example, U.S. Pat. No. 4,654,897, the tailless neck scarf, provides the user with a subtantially tailless scarf for the neck, tied by a fastener. The fastener is located in the front portion of the same. Although this design solves some of the problems associated with the extra scarf length and ease of tying, it continues to be limited in that it leaves a portion of the neck exposed to cold air. This is because the fastening devices are at the front ends of the scarf, and upon tying the same there will be a portion of the neck adjacent to the top of the users chest remaining unprotected. This area is located directly below the fastener. Tapering the ends, as suggested in the patent application, will tend to worsen the problem, leaving a greater area of the neck to be exposed to the elements. Even if the scarf described in this patent was wide enough to cover the totality of the users neck, the weak point at the base of the neck would still render this design faulty, since cold air leaking through the weak spot would eventually penetrate to all the neck area. Given the lesser surface area of contact used in hook and loop type fasteners, the air leak at the base of the neck will become an even greater problem.

Another less than ideal aspect of the above patent's design is that cold wind hitting the user directly in front would tend to have a lifting effect on the scarf, particularly in the bottom of the piece (at the base of the neck) that is caused by the users chest not being aerodinamic. This will cause the scarf to be unstable, necesitating something to hold it in place. If not held in place, this effect will tend to exacerbate the leakiness of the proposed design.

Moreover, the smaller tail, as proposed in this application, may become a nuisance to the wearer because the end tends to stick up when tightened completely. Thus the user will end up with a flap rather than a tail to contend with. This flap is not only not fashionable but will show readily is one desires to wear the scarf with a v-necked coat. In addition, wearing the scarf as proposed in the above patent with a v neck coat leaves a huge opening for cold air to penetrate through the chest of the user. Coupled with the leakiness aspects already discussed, the user is left with same original problem, how to completely and effectively cover himself.

Additionally, this design will fail because the cold air may leak through the fastening device itself and reach the users body. This is because the fastener constitutes an area of weakness in the piece itself, and the lack of material continuity allows the cold air to move inwards through the seal (fastener) as any fluid would do.

Further, the design is not reversible and does not include an easy to store device. Additionally, the design does not incorporate neck-foldability aspects that allows the user to protect both chest, neck and face or only chest and neck.

Finally, since this design is held together by a fastener placed in front of the users neck, it will tend to be fall out of place unless it is held by the friction between the users chin and the material which makes the scarf. This is a great disadvantage with the design because what the user needs to protect himself from cold and wind is the necessary stability in the scarf such that under normal head and chest motion, the device does not become undone and fail.

Pat. No. DES 339,676, the facial scarf, is another attempt to modify the traditional scarf design. This design incorporates the qualities of taillessness and ease of tying. However, it does not incorporate reversibility or ease of storage capabilities. Additionally, the facial scarf is held in place by the contact produced by the nose of the user and scarf. Given normal head motion or accelerated neck and head motion, the contact above stated may be reduced or eliminated causing the scarf to fail. Further, too much tension in the scarf may be uncomfortable for the users nose. Additionally, the design does not incorporate any chest protection or ease of storage devices and the neck is not foldable since the scarf is held in place by the users nose. Thus, should the user want to wear neck and chest protection only, it would not be possible with this design.

Pat. No. DES 368,571, the scarf, involves an ornamental design for a traditional scarf. Therefore, it is subject to the same limitations as are traditional scarfs.

U.S. Pat. No. 3,748,661, the adjustable scarf, also improves on traditional designs. It provides for an adjustable scarf, meaning that the tension in the scarf can be adjusted by means of a split ring. This design is essentially a neck only scarf and does not address the issue of chest or face protection, although it may be worn around the head. Further, when this scarf is worn, some cold air would leak through the front of the device because the ring causes the scarf material to compress in front, thus weakening the protection afforded by the device to a portion of the neck. This scarf is not reversible in the true sense of the word.

Other designs, such as U.S. Pat. No. 5,253,369, Method of Making a Reversible Scarf with a Visor, pertain to apparel to be worn on the head, rather than the face, neck and chest areas.

OBJECTS AND ADVANTAGES OF THE PRESENT DESIGN

The objects and advantages of the present design are as follows:

1) Multi color, multi material reversibility aspect that yields two scarfs in one 2) Simultaneous protection for the chest, neck and face from cold and wind.

3) Ease of storage by hanging.

4) Tailless and motion resistant design; will not undo itself with normal head, neck and chest motion. Provides greatly improved scarf stability.

5) Foldable feature which allows for neck height adjustments.

6) Chest and neck leakproof design. Eliminates leakiness due to wind lift on the scarf 7) User friendly tying design As required by the patent office, following is a brief description of the several drawings accompanying this application.

FIG. 1. Top view showing two conjugate patterns.

FIG. 2. Top view of the two other conjugate patterns.

FIG. 3 Top view of the hook used to make the scarf hangable

FIG. 4 Top view of the shape resulting from the fastening of the double sided parts constructed from FIGS. 1 and 2. Also, one possible location for the hook is shown. This shape will be called the instant reversible scarf, Niftyscarf.

FIG. 5*a* Front view of the Niftyscarf on a user showing one possible neck height FIG. 5*b* Front view of the Niftyscarf on a user showing another possible neck height FIG. 6 Back view of the Niftyscarf detailing the use of the fastening device

REFERENCE NUMERALS IN DRAWINGS

1. Depiction of pattern 1
2. Depiction of pattern 2
3. Curved edge in pattern 1
4. Curved edge in pattern 2
5. Straight edge in pattern 1
6. Straight edge in pattern 1 opposite to edge 5 of the same
7. Straight edge in pattern 2
8. Straight edge in pattern 2 opposite to edge 7 of the same
9. Straight edge in pattern 13
10. Curved edge in pattern 13
11. Straight edge in pattern 14
12. Curved edge in pattern 14
13. Depiction of patterns 13
14. Depiction of patterns 14
15. Depiction of the hook
16. Fastener
17. Fastener mate
18. Straight edge of the instant reversible scarf
19. Curved edge of the instant reversible scarf
20. Straight edge of the instant reversible scarf opposite to edge 18
21. Straight edge on pattern 13
22. Straight edge on pattern 14
23. Bottom edge of pattern 13
24. Bottom edge of pattern 14
25. Straight edge of pattern 1
26. Straight edge of pattern 2
27. Side edge of pattern 1
28. Side edge of pattern 2 opposite to edge 30
29. Side edge of pattern 1 opposite to edge 27
30. Side edge of pattern 2 opposite to edge 27

SUMMARY

The instantaneous reversible scarf, or Niftyscarf, is an innovative scarf designed to provide maximum protection from cold and wind to the chest and neck areas while at the same time, providing some degree of protection for the face and nose areas. It is essentially a neck, chest and face scarf that has the added advantages of being reversible, tailless, structurally stable, adjstable and easy to use and store (or hang).

DETAILED DESCRIPTION OF THE PREFERRED EMBODIMENT

Figure 2A:
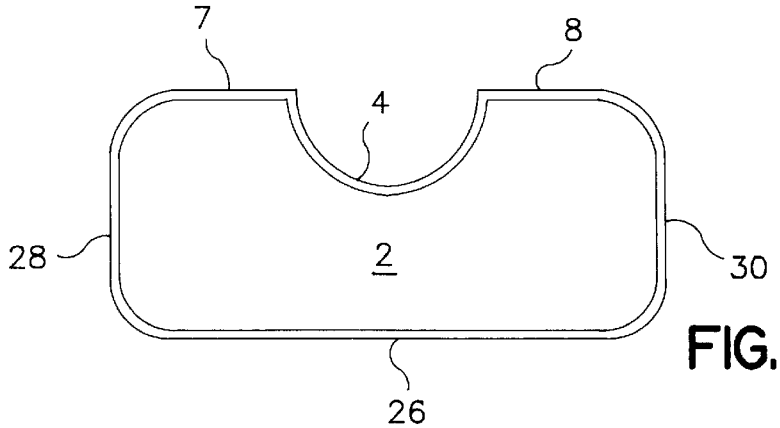
Figure 2B:
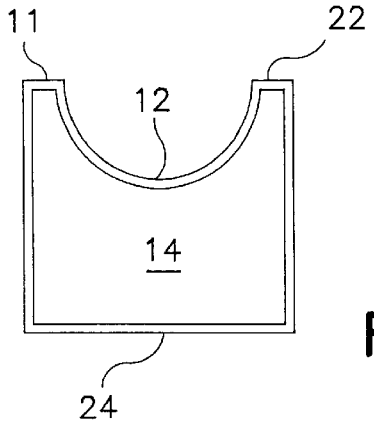
Figure 3:
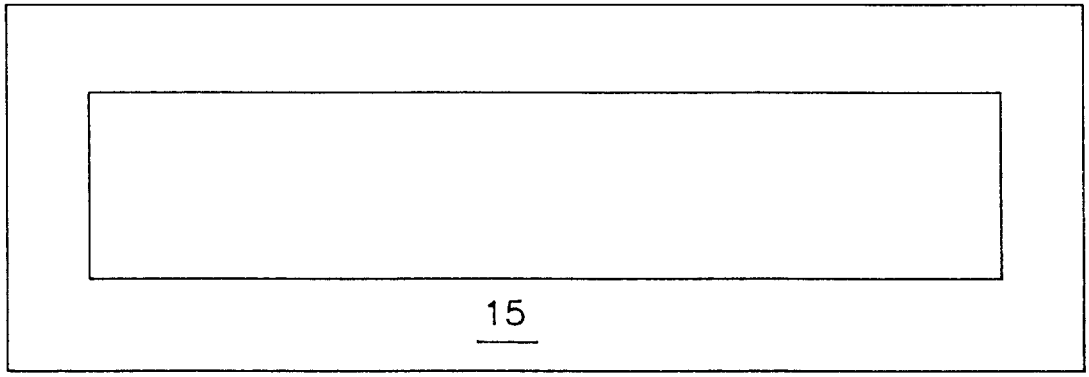

The instant reversible scarf consists of 5 parts shaped as shown in the attached top view drawings (see FIGS. 1–3). Patterns 1 and 2 consist of rectangular pieces of wearable material of varying dimensions from which a curved surface has been cut out. These pieces will be called the neckpieces. Their length closely approximates the diameter of the users neck.

Patterns 13 and 14 consist of rectangular shapes of wearable material and varying dimensions which have a curved surface indentation that exactly matches the indentation of patterns 1 and 2. Patterns 13 and 14 will be called the bibs or chestpieces. The horizontal length of the chestpieces approximates the width of the chest of the user. Patterns 1 and 2 are exactly similar in shape, but each pattern is made out of 2 different colors or materials or designs, as desired by the user. Patterns 13 and 14 are exactly similar in shape, but each pattern is made out of 2 different colors or materials or designs, as desired by the user. Although all patterns 1, 2, 13 and 14 may be fabricated of different colors, designs or materials, when patterns 1 and 13 are of the same color or material or design and patterns 2 and 14 are of the same color or material or design, a dual color or material or design reversible scarf results. FIG. 3 shows a hook, which is independently attached to the invention at the end of the construction for ease of storing and hanging. Patterns 1 and 13 will be called conjugate patterns. Likewise, patterns 2 and 14.

First, both conjugate patterns earlier obtained (patterns 1 and 13, and patterns 2 and 14) are sown or fastened together (1 to 13, 2 to 14). The sewing or fastening is done inside out such that when the parts are turned right side in later, the sewing or fastening does not show.

The sewing or fastening is done by placing parts 1 and 13 together such that edges 3 and 10, 5 and 9, and 6 and 21 coincide. Likewise, edges 7 and 11, 4 and 12, and 8 and 22 in the second set of conjugates must coincide.

Figure 4:
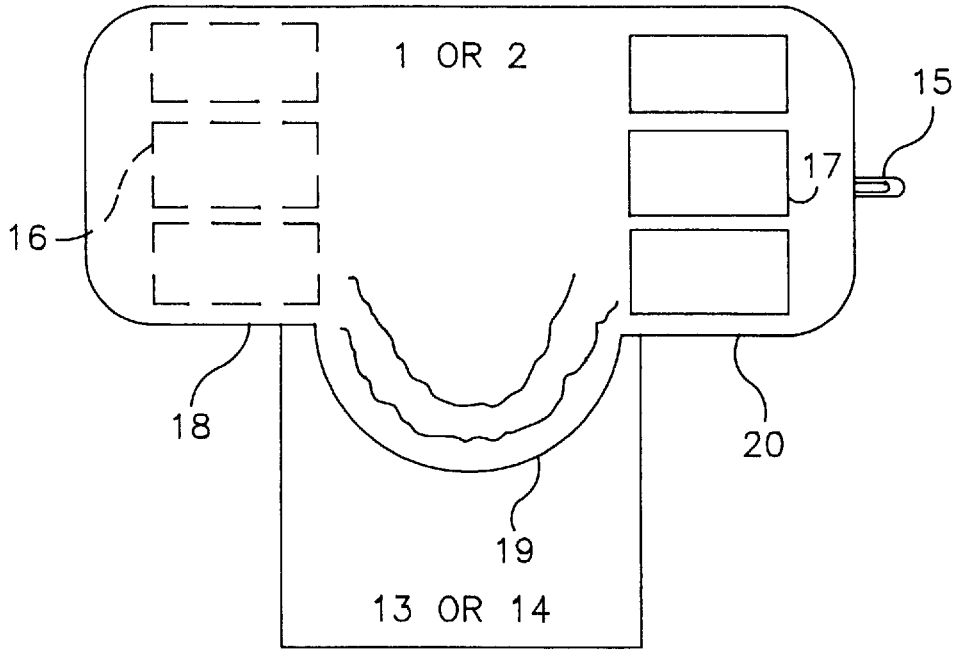

Second, the parts resulting from the fastening of the two conjugate parts sown or fastened together earlier are joined to make a single part. This is done by placing one part over the other such that the following edges coincide: 28 with 27, 25 with 26, 30 and 29, and 23 with 24. The sewing or fastening, which again is done inside out, extends all along the contact line of the two parts as shown in FIG. 4. A small gap in the sewing or fastening is left to allow the part to be turned right side in.

Third, the resulting shape is turned right side in so as to hide the fastening at the edges. Minimal fastening or sewing is done to close the gap left earlier to allow the part to be turned right side in.

Fourth, a fastener or fastening device 16 and its mate 17 is attached to opposite ends and opposite faces of the neckpiece, as shown in FIG. 4, top view of the resulting shape (fastening device shown both solid and dotted lines). The fastener has the purpose of holding the shape in placed once it has been placed on the users body. FIG. 4 also shows a top view of the instant reversible scarf. The placing of the fastener can be done vertically or horizontally, and the choice will depend on the height of the neckpiece.

Fifth, a hook 15 is fastened to one side of the resulting shape (see FIG. 4) so as to facilitate the hanging or storing of the same. Additional stitches or ornaments can be place in various parts of the resulting shape for ornamental purposes.

OPERATION OF INVENTION

Figure 5A:
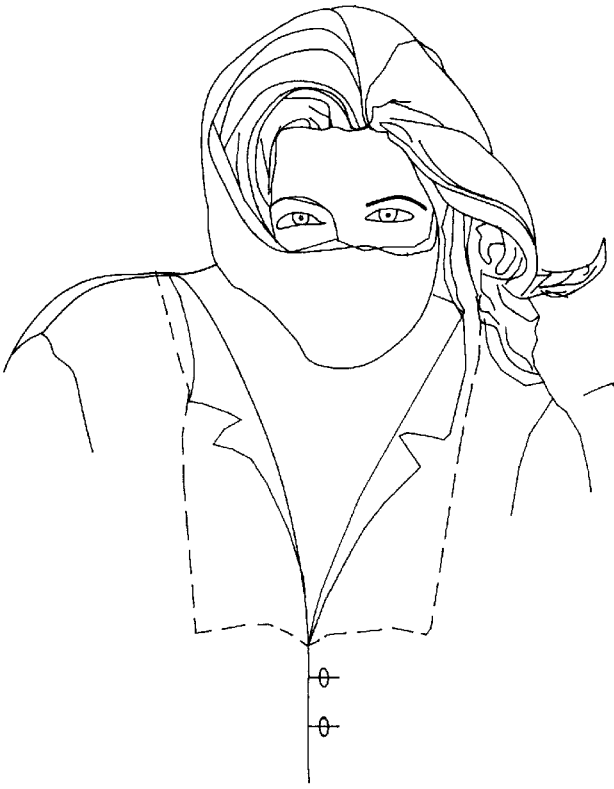
Figure 5B:
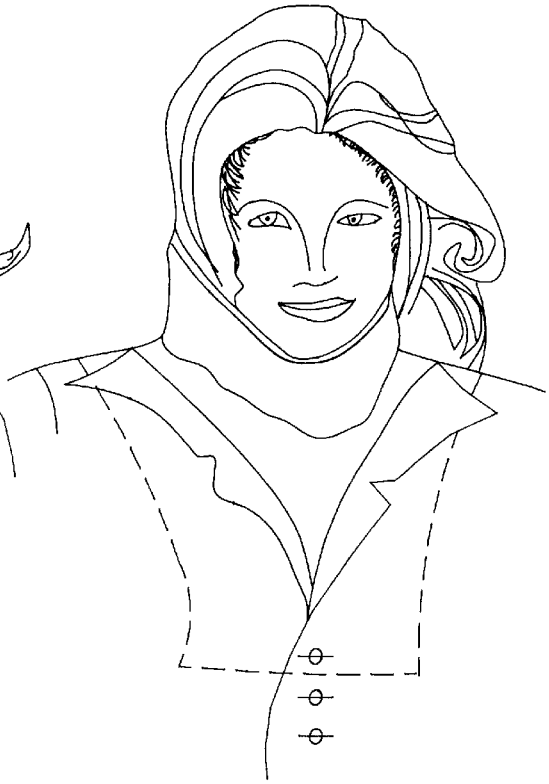

The niftyscarf is used by placing the chestpiece on the users chest and closing the neckpiece by using the fastening device. FIGS. 5*a* and 5*b* shows a front view of the scarf on the user. The height of the neckpiece can be adjusted by folding to reduce its dimension, thus allowing the user the choice to cover both neck, face and chest, or only neck and chest.

The instantaneous scarf is truly reversible and can be used as such. For example, one face can be one color and the other another, thus allowing the user to have two scarfs in one. In addition, it is tailless and easily stored by hanging.

Also, the design is motion resistant, that is, it does not undo itself with normal head and neck motion, as do ordinary scarfs. The design is also wind lift proof meaning that, the chestpiece provides the necessary grip to hold the piece in place during high wind conditions. That is, wind hitting the user from the front will tend to push the chestpiece into the users body which in turn will cause the scarf to tighten on the user.

The addition of the chestpiece also improves the stability of the piece since it tends to oppose the downward motion of the neckpiece due to its weight. Thus the neckpiece is held in place by the fastener pulling it from the back of the users neck and the chestpiece pushing against it.

Further, the curved nature of both the chestpiece and the neckpiece help stabilize the piece by causing the same to friction against the users body. Thus, under normal conditions, undoing of this scarf is highly unlikely. Further, by including the fastening device in the back of the neck, the issue of taillessness is completely resolved in that no flaps will generally exist beyond the back of the neck. Moreover, should one develop because the user is using a bigger than expected design, it would be held back by the users coat.

Figure 6:
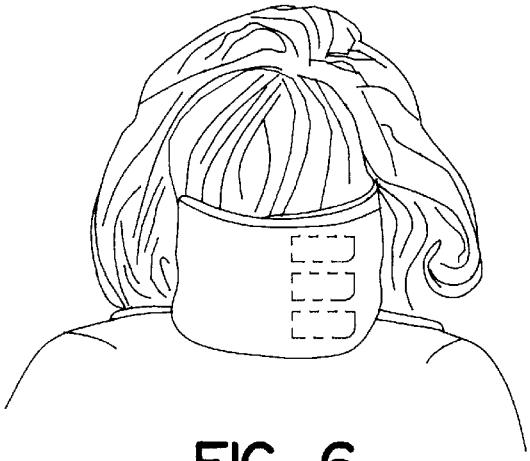

A back view of the scarf on a user is shown in FIG. 6. This view also shows how the fastener holds together the scarf.

SUMMARY, RAMIFICATIONS AND SCOPE

As described earlier, the instantaneous reversible scarf consisting of a neckpiece, a bib or chestpiece and a hook, can be used to replace traditional scarf designs. It has the advantages of being:

1) Multi color, multi design and multiple material reversible scarf for face, neck, and chest (in the preferred embodiment)

2) Foldable neckpiece such that the neck can be adjusted to protect both neck and chest or neck, chest and face.

3) Impermeable, will not leak cold or wind into neck and chest

4) Easy to store by hanging from a hook

5) Motion resistant and stable design will not undo itself with normal body motion.

6) Easy to tie and tailless

Although the description above contains many specificities, these should not be construed as limiting the scope of the invention but as merely providing illustrations of the preferred embodiments of the invention. For example, the a zipper type closure rather than a fastener (such as VELCRO) can be used. Thus, the scope of the claims should be determined by the appended claims rather than the examples given.

I claim:

1. A neck, face and chest scarf comprising:

a pair of neckpieces of a flexible material having opposed ends, each neckpiece having a front face and a rear face and mounted together so that the rear face of one neckpiece is adjacent the rear face of the other neckpiece with a curved indentation between the ends approximating a circumference of a wearer's neck and having a foldable width;

a pair of chestpieces of material having a curved indentation which matches the curved indentation of the neckpieces, wherein the chestpieces are fastened to the neckpieces so that the indentations of the neckpieces coincide with the indentations of the chestpieces;

a fastening means having a first half and a second half and mounted on the opposed ends of the neckpieces so that the first half of the fastening means is on the front face of the one neckpiece at one end and the second half of the fastening means is on the front face of the other neckpiece at the other end such that tension in the neckpiece is adjusted by joining the first half and the second half of the fastening means together at a plurality of locations; and a hook mounted on the front face of one of the neckpieces to facilitate storing of the scarf by hanging.

2. The scarf of claim 1 wherein the neckpieces are substantially rectangular.

3. A neck, face and chest scarf comprising:

a neckpiece of flexible material having opposed ends with a front face and a rear face and having a curved indentation between the ends which approximates a circumference of a wearer's neck and having a foldable width;

a chestpiece of material having a curved indentation which matches the curved indentation of the neckpiece, wherein the chestpiece is fastened to the neckpiece so that the indentation of the neckpiece coincides with the indentation of the chestpiece;

a fastening means having a first half and a second half and mounted on the opposed ends of the neckpiece so that the first half of the fastening means is on the front face of the neckpiece at one end and the second half of the fastening means is on the front face of the neckpiece at the other end such that tension in the neckpiece can be adjusted by joining the first half and the second half of the fastening means together at a plurality of locations; and a hook mounted on the front face of the neckpiece to facilitate storing of the scarf by hanging.

4. The scarf of claim 3 wherein the neckpiece is substantially rectangular.

5. A neck, face and chest scarf comprising:

a pair of substantially rectangular neckpieces of a flexible material having opposed ends, each neckpiece having a front face and a rear face and mounted together so that the rear face of one neckpiece is adjacent the rear face of the other neckpiece with a curved indentation between the ends approximating a circumference of a wearer's neck and having a foldable width;

a pair of chestpieces of material having a curved indentation which matches the curved indentation of the neckpieces, wherein the chestpieces are fastened to the neckpieces so that the indentations of the neckpieces coincide with the indentations of the chestpieces; and a fastening means having a first half and a second half and mounted on the opposed ends of the neckpieces so that the first half of the fastening means is on the front face of the one neckpiece at one end and the second half of the fastening means is on the front face of the other neckpiece at the other end such that tension in the neckpiece is adjusted by joining the first half and the second half of the fastening means together at a plurality of locations.

6. The scarf of claim 5 wherein a hook is mounted on the front face of one of the neckpieces to facilitate storing of the scarf by hanging.

7. A neck, face and chest scarf comprising:

a substantially rectangular neckpiece of flexible material having opposed ends with a front face and a rear face and having a curved indentation between the ends which approximates a circumference of a wearer's neck and having a foldable width;

a chestpiece of material having a curved indentation which matches the curved indentation of the neckpiece, wherein the chestpiece is fastened to the neckpiece so that the indentation of the neckpiece coincides with the indentation of the chestpiece;

a fastening means having a first half and a second half and mounted on the opposed ends of the neckpiece so that the first half of the fastening means is on the front face of the neckpiece at one end and the second half of the fastening means is on the rear face of the neckpiece at the other end such that tension in the neckpiece can be adjusted by joining the first half and the second half of the fastening means together at a plurality of locations.

8. The scarf of claim 7 wherein a hook is mounted on the front face of the neckpiece to facilitate storing of the scarf by hanging.

* * * * *

UNITED STATES PATENT AND TRADEMARK OFFICE

CERTIFICATE OF CORRECTION

PATENT NO. : 5,802,618

DATED : September 8, 1998

INVENTOR(S) : Eduardo J. Mustata

It is certified that error appears in the above-identified patent and that said Letters Patent is hereby corrected as shown below:

Title page, the inventor's address should be --535 Glenmoor, #3B, East Lansing, Michigan 48823--.

Figure 1A:
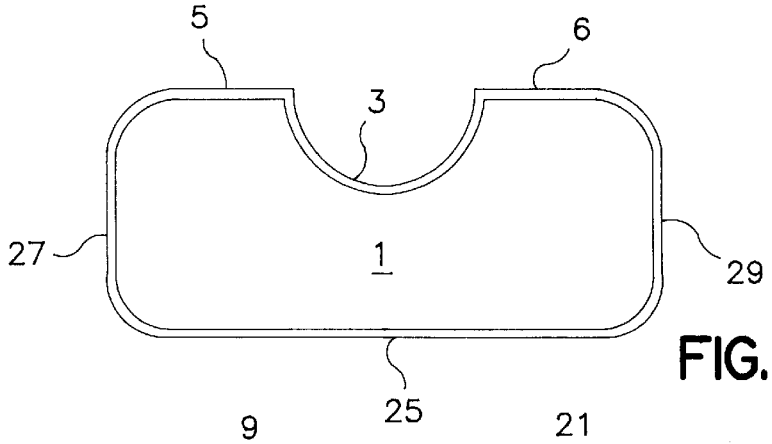
Figure 1B:
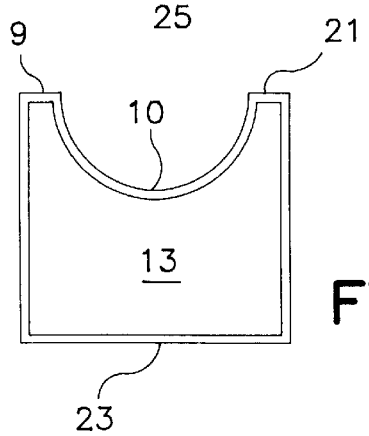

Column 3, line 49, "FIG. 1" should be --FIGS. 1A and 1B--.

Column 3, line 50, "FIG. 2" should be --FIGS. 2A and 2B--.

Column 3, line 55, "FIGS. 1 and 2" should be --FIGS. 1A, 1B, 2A and 2B--.

Column 3, line 58, "FIG. 5a" should be --FIG. 5A--.

Column 3, line 60, "FIG. 5b" should be --FIG. 5B--.

Column 4, line 29, "edge 27" should be --edge 28--.

Column 4, line 38, "adjstable" should be --adjustable--.

UNITED STATES PATENT AND TRADEMARK OFFICE

CERTIFICATE OF CORRECTION

PATENT NO. : 5,802,618

DATED : September 8, 1998

INVENTOR(S) : Eduardo J. Mustata

It is certified that error appears in the above-identified patent and that said Letters Patent is hereby corrected as shown below:

Column 4, line 45, "(see FIGS. 1-3)" should be --(see FIGS. 2A, 1B, 2A, 2B and 3)--.

Column 5, line 46, "FIGS. 5a and 5b" should be --FIGS. 5A and 5B--.

Column 7, line 13 (Claim 3), "front" should be --rear--.

Signed and Sealed this

Sixteenth Day of March, 1999

*Attest:*

*Attesting Officer*

Q. TODD DICKINSON

*Acting Commissioner of Patents and Trademarks*